United States Patent [19]

Dreeben

[11] 4,441,422

[45] Apr. 10, 1984

[54] CAPILLARY STENCIL PRINTER WITH IMPROVED REPLENISHMENT OF THE PRINTING PAD AND RE-INKING OF THE RESERVOIR

[76] Inventor: Lionel Dreeben, 525 White Horse Pike, Atco, N.J. 08004

[21] Appl. No.: 337,976

[22] Filed: Jan. 8, 1982

[51] Int. Cl.[3] ..... B41L 27/26

[52] U.S. Cl. ..... 101/125

[58] Field of Search ..... 101/125, 327, 333, 367, 101/368, 405, 114; 118/264, 265, 266–269

[56] References Cited

U.S. PATENT DOCUMENTS

| | | | |
|---|---|---|---|
| 1,468,512 | 9/1923 | Pritchard | 101/125 |
| 2,199,265 | 4/1940 | Lohrey | 101/327 X |
| 2,318,465 | 5/1943 | Chollar | 101/327 X |
| 2,462,929 | 3/1949 | Zodtner | 401/223 |
| 2,490,902 | 12/1949 | Goodwin | 101/327 |
| 2,528,408 | 10/1950 | Zodtner | 401/223 |
| 2,847,972 | 8/1958 | Rosenthal | 118/265 |
| 2,905,085 | 9/1959 | Mercer et al. | 101/327 X |
| 3,218,967 | 11/1965 | Childress | 101/114 |

FOREIGN PATENT DOCUMENTS

| | | | |
|---|---|---|---|
| 374277 | 6/1932 | United Kingdom | 118/264 |

*Primary Examiner*—Paul T. Sewell
*Assistant Examiner*—John A. Weresh
*Attorney, Agent, or Firm*—Robert K. Youtie

[57] ABSTRACT

A stencil printer for printing the underside of a web including a vertically reciprocable upwardly opening printing head or receptacle mounted beneath a web to be printed, a reservoir for ink in a lower region of the receptacle, a printing pad in an upper region of the receptacle in fluid communication with the reservoir and presented upwardly through the reservoir opening for printing through a stencil on the printing pad.

3 Claims, 4 Drawing Figures

FIG. 1
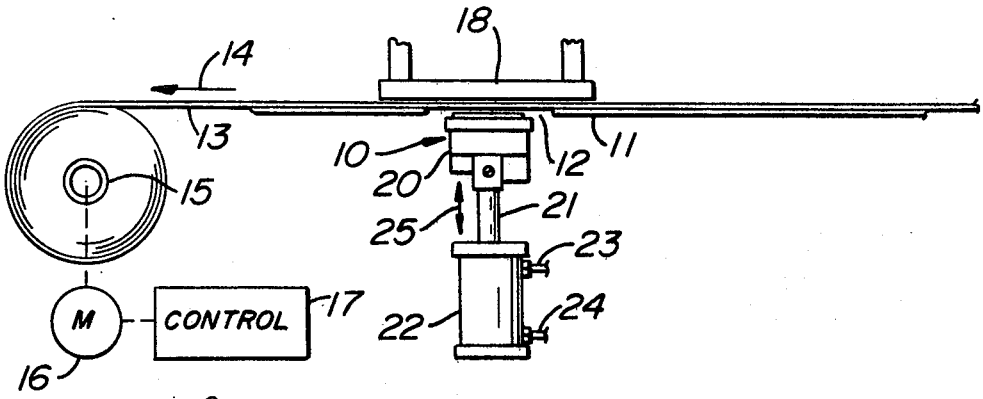
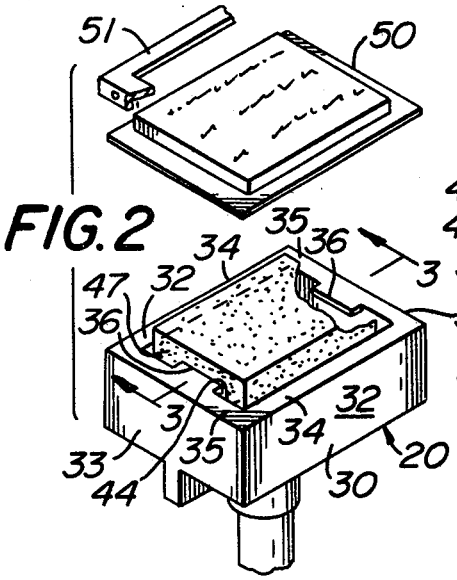
FIG. 2
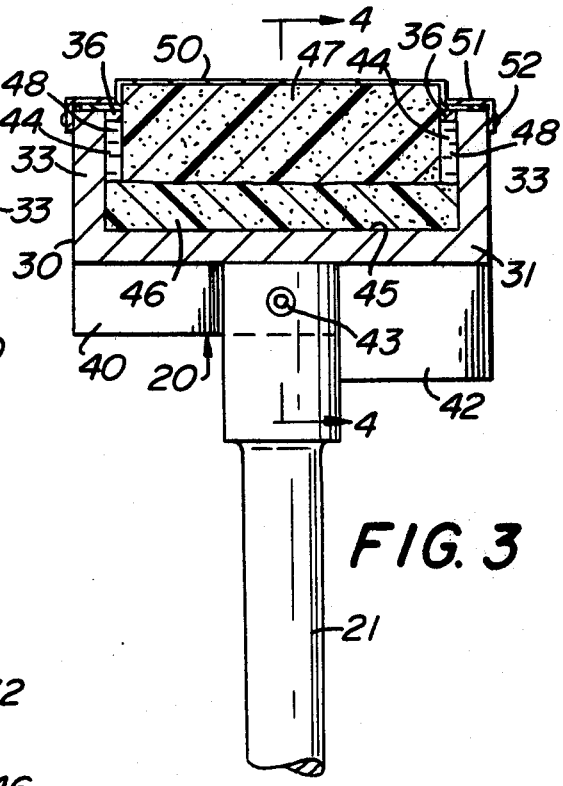
FIG. 3
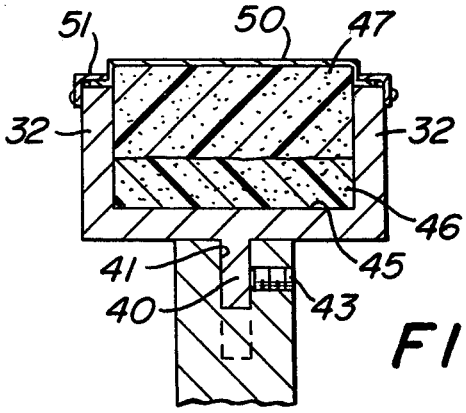
FIG. 4

CAPILLARY STENCIL PRINTER WITH IMPROVED REPLENISHMENT OF THE PRINTING PAD AND RE-INKING OF THE RESERVOIR

BACKGROUND OF THE INVENTION

In the past, stencil printers for high speed automatic equipment did not provide for quick and easy re-inking of the printer, but required time consuming shut-down of the equipment and replacement of an ink-depleted printing pad with a pre-inked pad.

The prior art of which the inventor is aware includes the following:

| U.S. PAT. NO. | PATENTEE |
|---|---|
| 2,020,151 | Madden |
| 2.346,023 | Gold |
| 2,667,119 | Thomas |
| 3,221,647 | Carlsen |
| 3,832,947 | Funahashi |

SUMMARY OF THE INVENTION

It is an important object of the present invention to provide a stencil printer for the underside of a web which overcomes the abovementioned difficulties, is capable of rapidly repetitive printing in high speed equipment through a relatively long working period without excessive depletion of ink, and which may be quickly and easily resupplied with ink, usually without special down-time for re-inking.

It is a further object of the present invention to provide a stencil printer of the type described in the preceding paragraph which is extremely simple in construction, highly economical in both saving of machine down-time for replacing printing pads and saving the cost of replacement pads; and wherein the structure is sturdy and reliable for a long useful life.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scope will be indicated by the appended claims.

BRIEF DESCRIPTION OF THE DRAWINGS

FIG. 1 is an elevational view, somewhat diagrammatic, illustrating a stencil printer of the present invention in operative association with apparatus handling a web to be printed.

FIG. 2 is a top perspective view, partly exploded and partly broken away, showing the stencil printer of the present invention with a stencil removed from the printing head.

FIG. 3 is a sectional elevational view showing the printing head of FIG. 2 in assembled condition, generally along the line 3—3 of FIG. 2, and enlarged for clarity.

FIG. 4 is a sectional elevational view taken generally along the line 4—4 of FIG. 3.

DESCRIPTION OF THE PREFERRED EMBODIMENT

Referring now more particularly to the drawings, and specifically to FIG. 1 thereof, a web printing apparatus is generally designated 10, and arranged below a support plate or table 11 in alignment with an opening 12 in the table. A web 13 is being fed, say in the direction of arrow 14, as by winding on a reel 15 being driven by suitable motive means 16 and control means 17. Located over the opening 12 of the plate or table 11 is a generally horizontal backing member or plate 18.

The printing apparatus 10 may include a printing head 20 mounted below the plate 11 in alignment with the plate opening 12. The printing head 20 may be carried on the upper end of an upright shaft or piston rod 21, which may be vertically reciprocable, as in the directions of arrows 25. The vertical shifting movement of rod or shaft 21 may be obtained by any suitable means, in proper synchronism with stepped or intermittent movement of the web 13, as by a piston-and-cylinder assembly 22, operated by fluid pressure though conduits 23 and 24.

The printing head 20 may include an upwardly facing hollow housing or receptacle 30, which may be generally boxlike in configuration, having a generally rectangular bottom wall 31, from which upstand a pair of opposed side walls 32, and a pair of opposed upstanding end walls 33, each extending between the ends of a pair of side walls 32. The side and end walls 32 and 33 may terminate in generally horizontal, coplanar or flush upper edges 34 and 35, respectively. Further, there are advantageously provided, spaced medially between the ends of walls 33, inward projections or spacers 36, which may be flush with the upper wall edges 35. That is, a generally rectangular lug or spacer 36 may project inwardly from each receptacle wall 33, say flush with the upper edge thereof and spaced between the other opposed receptacle walls 32.

Depending from the underside of receptacle bottom wall 31 may be a mounting member or flange 40 for engagement in an upper end formation or slot 41 of the piston rod or shaft 21. The mounting member or flange 40 may include a locating portion or extension 42 engagable with one side of the rod 21 when the flange 40 is properly seated in the slot 41. Suitable fastener means, such as a set screw 43 in the rod 21 may removably secure the printing head 20 in fixed relation with respect to the reciprocable rod 21.

The interior of the receptacle 30 may be defined by a generally rectilinear hollow 45 bounded within the receptacle bottom wall 31 and receptacle side walls 32 and 33, the hollow opening upwardly from the space between the side walls.

Seated in a lower region of the receptacle hollow 45, as on the bottom wall 31 and conformably engaging the receptacle side and end walls 32 and 33, may be a generally rectangular reservoir body or pad 46. The reservoir body or pad 46 thus completely covers the bottom wall 31 to completely occupy the lower region of the receptacle hollow 45, and is advantageously of a rapidly ink absorbing construction. It has been found entirely satisfactory to utilize as a reservoir body a pad consisting of glass beads, and therefore having a multiplicity of interstices which readily and rapidly absorb ink under atmospheric pressure.

In an upper region of the receptacle hollow 45, and projecting upwardly and outwardly through the upper end opening of the receptacle 30, is a printing body or part 47, of slowly ink absorbing characteristics. That is, the printing pad 47 may be a conventional capillary printing pad, adapted to be filled with ink and dispense the ink by capillary action. An example of such a printing pad is that sold under the trademark "PORELON". Such printing pads are usually initially filled with ink under vacuum so that a maximum of ink is absorbed, and the printing pad of the instant invention may be initially so filled.

In the printing head 20, the printing pad 47 advantageously rests on and in contact with the reservoir body 46, the printing pad and reservoir body therefore being in fluid communication with each other for feeding of ink from the reservoir body by capillary action upwardly into the printing pad, and subsequent printing by impression from the upperside of the printing pad, in the usual manner.

The printing pad 47 may be generally rectangular in configuration, say extending between the receptacle walls 32, and extending between the inner extremities of the projections 36 so as to be spaced from the receptacle walls 33. This defines upwardly opening slots, cavities or passageways 44 communicating downwardly through the open upperside of the receptacle 30, on opposite sides of the printing pad 47 to opposite end regions of the nether pad or reservoir body 46. These slots or passageways 44 provide for the passage of ink 48 from exteriorly of the printing head 20 to the reservoir body 46 for rapid refilling of the reservoir with ink.

A stencil sheet is shown at 50 overlying the upper surface of the printing body 47, and a removable frame is designated 51, being superposed on the upper receptacle edges 34 and 35 to retain the stencil 50 in position. Of course, the stencil 50 is suitably cut to permit passage therethrough of ink from a printing pad 49 upon impression with the underside of the web 13; and, the stencil may be removed and replaced, as by removal of frame fasteners 52, as desired.

Also, upon depletion of ink from the printing pad 47, mere removal of the frame 51 and stencil 50 to expose the slots or passageways 44 permits of the introduction of ink into the slots for gravitational movement therethrough to re-ink the reservoir pad 46. By its nature the reservoir pad 46 is relatively rapidly re-inked with a very substantial quantity of ink, as by gravity and capillary action to absorb ink in the reservoir pad. However, the printing pad 47 relatively slowly absorbs ink from the reservoir pad 46 and passes ink relatively slowly through the stencil upon printing, so as to require re-inking only relatively infrequently.

From the foregoing it is seen that the present invention provides a re-inkable stencil printer which is extremely simple in construction and operation, durable and reliable throughout a long useful life, and which otherwise fully accomplishes its intended objects.

Although the present invention has been described in some detail by way of illustration and example for purposes of clarity of understanding, it is understood that certain changes and modifications may be made within the spirit of the invention.

What is claimed is:

1. A stencil printer for printing the underside of a web, said printer comprising a receptacle mounted for vertical reciprocation beneath the web, said receptacle having an opening facing upwardly toward the web, two opposite sides of said opening having spacer elements projecting into said opening a reservoir pad consisting of glass beads in a lower interior region of said receptacle adaped to rapidly absorb a large quantity of ink, an ink absorbing capillary printing pad in an upper region of said receptacle between said spacer elements and in contacting fluid communication with said reservoir body and adapted to slowly absorb ink from the latter, gravitational ink replenishing means in said receptacle communicating downwardly between said spacer elements, said printing pad and the sides of said opening from exteriorly of and over said receptacle into said receptacle to said reservoir body for gravitationally replenishing ink to the reservoir body, and stencil holding means for holding a stencil on the upper surface of said printing pad to print through said stencil, said stencil holding means, when in place, closing said gravitational ink replenishing means.

2. A stencil printer according to claim 1, said printing pad being spaced from a wall of said receptacle to provide a feeding passageway defining said replenishing means.

3. A stencil printer according to claim 2, said reservoir body conformably and completely occupying the lower interior region of said receptacle, said printing pad being seated on and occupying less than the entire upper surface of said reservoir body for capillary fluid communication therewith, the space between said printing pad and receptacle wall opening downwardly to the unoccupied surface region of said reservoir for gravitational feeding therethrough of ink to said reservoir body.

* * * * *